US010366811B2

(12) United States Patent
Kobayashi

(10) Patent No.: US 10,366,811 B2
(45) Date of Patent: Jul. 30, 2019

(54) PARALLEL PAIR CABLE

(71) Applicant: SUMITOMO ELECTRIC INDUSTRIES, LTD., Osaka-shi, Osaka (JP)

(72) Inventor: Yuto Kobayashi, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/704,135

(22) Filed: Sep. 14, 2017

(65) Prior Publication Data

US 2018/0075948 A1 Mar. 15, 2018

(30) Foreign Application Priority Data

Sep. 15, 2016 (JP) ..... 2016-180533
Apr. 20, 2017 (JP) ..... 2017-083772

(51) Int. Cl.

| | |
|---|---|
| ***H01B 11/10*** | (2006.01) |
| ***H01B 7/29*** | (2006.01) |
| ***H01B 7/36*** | (2006.01) |
| ***H01B 11/20*** | (2006.01) |
| *H01B 11/18* | (2006.01) |

(52) U.S. Cl.

CPC ..... *H01B 11/1008* (2013.01); *H01B 7/29* (2013.01); *H01B 7/36* (2013.01); *H01B 11/20* (2013.01); *H01B 11/1091* (2013.01); *H01B 11/1826* (2013.01)

(58) Field of Classification Search

CPC ... H01B 7/17; H01B 7/29; H01B 7/36; H01B 9/021; H01B 9/022; H01B 11/10; H01B 11/20; H01B 11/183; H01B 11/1008; H01B 11/1025; H01B 11/1091; H01B 11/1826; H01B 11/1895; H01B 13/02; H05K 9/0075; H05K 9/0098

USPC ..... 174/36, 113 R, 108

See application file for complete search history.

(56) References Cited

U.S. PATENT DOCUMENTS

| | | | | |
|---|---|---|---|---|
| 6,225,556 | B1 * | 5/2001 | Saito | H01F 1/14725 148/668 |
| 7,790,981 | B2 | 9/2010 | Vaupotic et al. | |
| 9,324,479 | B2 * | 4/2016 | Sugiyama | H01B 11/002 |
| 2004/0026101 | A1 | 2/2004 | Ochi | |
| 2012/0193122 | A1 * | 8/2012 | Sugiyama | H01B 11/183 174/113 R |
| 2014/0027151 | A1 * | 1/2014 | Huang | H01B 7/17 174/109 |
| 2017/0020037 | A1 * | 1/2017 | Nakatani | H01B 9/021 |

FOREIGN PATENT DOCUMENTS

| | | |
|---|---|---|
| CN | A-102623090 | 8/2012 |
| JP | 2002-319319 A | 10/2002 |

* cited by examiner

*Primary Examiner* — Timothy J Thompson
*Assistant Examiner* — Guillermo J Egoavil
(74) *Attorney, Agent, or Firm* — Drinker Biddle & Reath LLP

(57) ABSTRACT

A parallel pair cable includes a pair of insulated wires arranged to be in contact with each other, parallel to each other and not twisted, a first resin tape wrapped around the pair of insulated wires, and a shield tape longitudinally folded on the outside of the first resin tape and comprising a metal layer.

3 Claims, 5 Drawing Sheets

PARALLEL PAIR CABLE

CROSS-REFERENCE TO RELATED APPLICATION

The present application claims priorities from Japanese Patent Application No. 2016-180533 filed on Sep. 15, 2016 and Japanese Patent Application No. 2017-083772 filed on Apr. 20, 2017, the entire content of which is incorporated herein by reference.

BACKGROUND

Technical Field

The present invention relates to a parallel pair cable.

Related Art

Parallel pair cables are known, which have a conductive shield tape wrapped around a pair of insulated wires arranged parallel to each other and an insulating tape wrapped on the outside of the shield tape (e.g., see Patent Documents 1 and 2).

[Patent Document 1] Japanese Patent Application Publication No. 2002-319319

[Patent Document 2] U.S. Pat. No. 7,790,981

Upon transmission of differential signals through such a parallel pair cable, when distance between the conductive shield tape and signal lines (such as insulated wires) fluctuates along the length of the cable, there is a risk that a shielding effect thereof on the signal lines becomes unstable and thus an amount of output of common mode (Scd21) with respect to input signal of differential mode is increased.

SUMMARY

Exemplary embodiments of the invention provide a parallel pair cable, in which upon transmission of differential signals, an amount of output of common mode (Scd21) with respect to input signal of differential mode can be reduced.

A parallel pair cable according to an exemplary embodiment, comprises:

a pair of insulated wires arranged to be in contact with each other, parallel to each other, and not twisted;

a first resin tape wrapped around the pair of insulated wires; and a shield tape comprising a metal layer longitudinally folded on the outside of the first resin tape.

According to the above invention, upon transmission of differential signals, an amount of output of common mode (Scd21) with respect to input signal of differential mode can be reduced.

Figure 1:
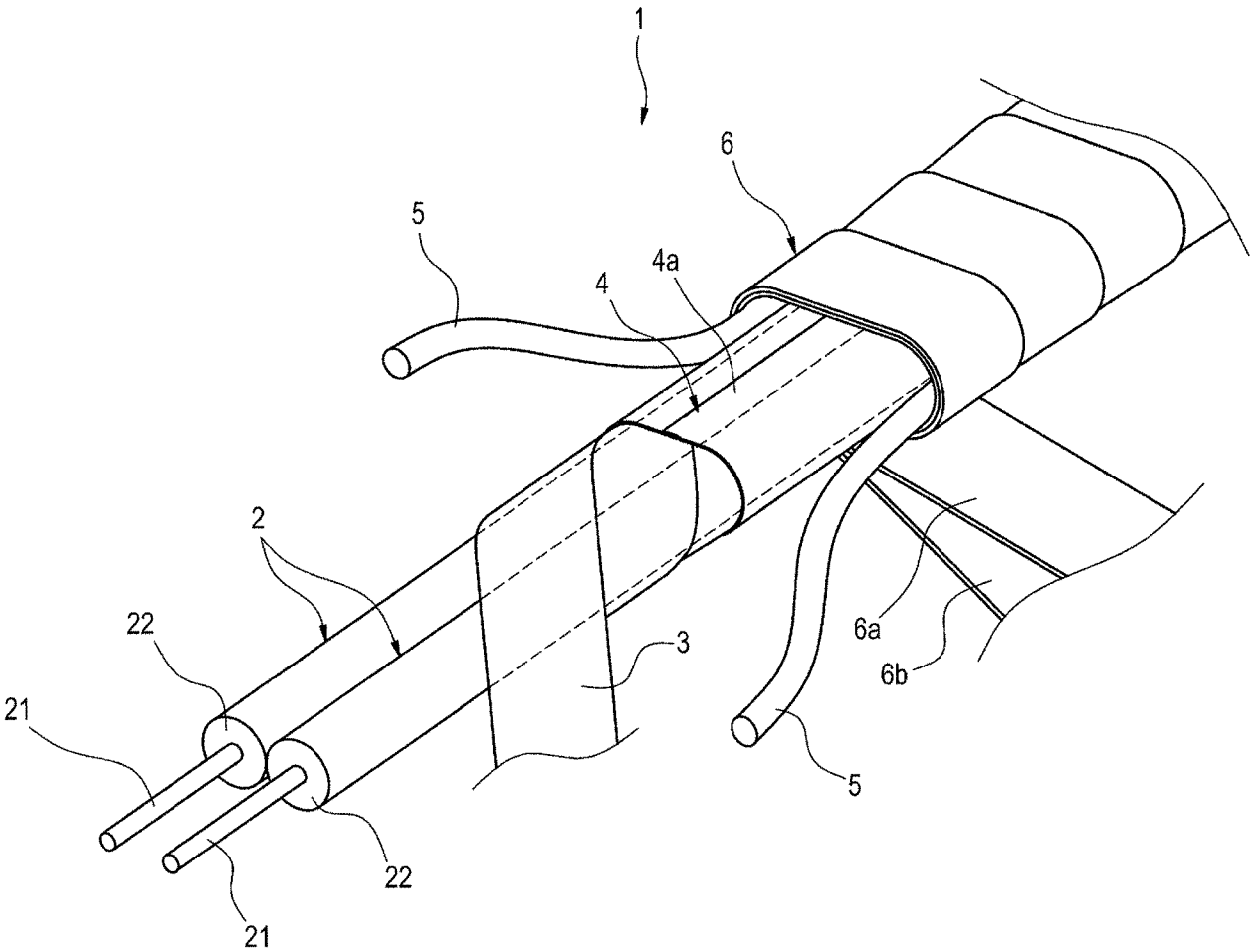
FIG. 1 is a perspective view showing a configuration of a parallel pair cable according to a first embodiment.

DETAILED DESCRIPTION (Description of Embodiments of the Invention)

First of all, embodiments of the present invention are listed and described below.

(1) A parallel pair cable according to an exemplary embodiment of the invention, comprises:

a pair of insulated wires arranged to be in contact with each other, parallel to each other, and not twisted;

a first resin tape wrapped around the pair of insulated wires; and a shield tape comprising a metal layer longitudinally folded on the outside of the first resin tape.

According to the above configuration, the pair of insulated wires arranged to be in contact with and parallel to each other are wrapped with the first resin tape, thereby reliably fixing positions of two insulated wires relative to each other. Also, since the shield tape is longitudinally folded on the outside of the first resin tape, a good electrical property is obtained as compared with a case that the shield tape is spirally wrapped. The "longitudinally folded" means that the edge of the shield tape runs straightly along the longitudinal direction like cigarette paper. As a result, a shielding effect of the shield tape on the insulated wires (signal lines) can be stabilized and also an amount of output of common mode (Scd21) with respect to input signal of differential mode can be reduced.

(2) The parallel pair cable may comprise:

a drain wire outside the shield tape, wherein the drain wire is arranged to be in electrical contact with the metal layer of the shield tape.

Since the drain wire is provided outside the shield tape, there is no drain wire inside the shield tape and thus the shield tape can be brought into close contact with the first resin tape inside thereof without a gap therebetween.

(3) The parallel pair cable may comprise:

a jacket layer provided around the shield tape and the drain wire.

By providing the jacket layer, the shield tape can be electrically insulated. Also, the cable can be configured to be protected from being contaminated from the exterior and also to have water resistance.

(4) The parallel pair cable may comprise:

a conductive tape helically wrapped on the outside of the shield tape;

wherein the drain wire is arranged on the outside of the conductive tape so that the drain wire is electrically connected to the conductive tape and the shield tape;

wherein the jacket layer is provided around the conductive tape and the drain wire.

Since the conductive tape is helically wrapped (spirally wrapped) on the outer circumference of the shield tape, a crease is less created on the shield tape and also an un-uniformity in shielding effect of the shield tape on the insulated wires (signal lines) is less occurred.

As a result, an amount of output of common mode (Scd21) with respect to input signal of differential mode can be reduced and also an un-uniformity thereof can be reduced.

(5) The jacket layer may be a layer formed by wrapping a second resin tape around the shield tape and the drain wire.

Since the second resin tape is wrapped, the shield tape and drain wire can be reliably electrically connected with each other.

(6) A wrapping direction of the second resin tape may be opposite to a wrapping direction of the first resin tape.

Since the second resin tape, which forms the jacket layer, is wrapped in a direction opposite to that of the first resin tape, it can be made difficult for the insulated wires to be twisted.

(Details of the Embodiments of the Present Invention)

Detailed examples of a parallel pair cable according to the embodiments of the present invention will be now described with reference to the accompanying drawings.

Meanwhile, the present invention is not limited to the examples, but is intended to be defined by the appended claims and also to encompass all modifications within the meaning and scope equivalent to the claims.

First Embodiment

Figure 2:
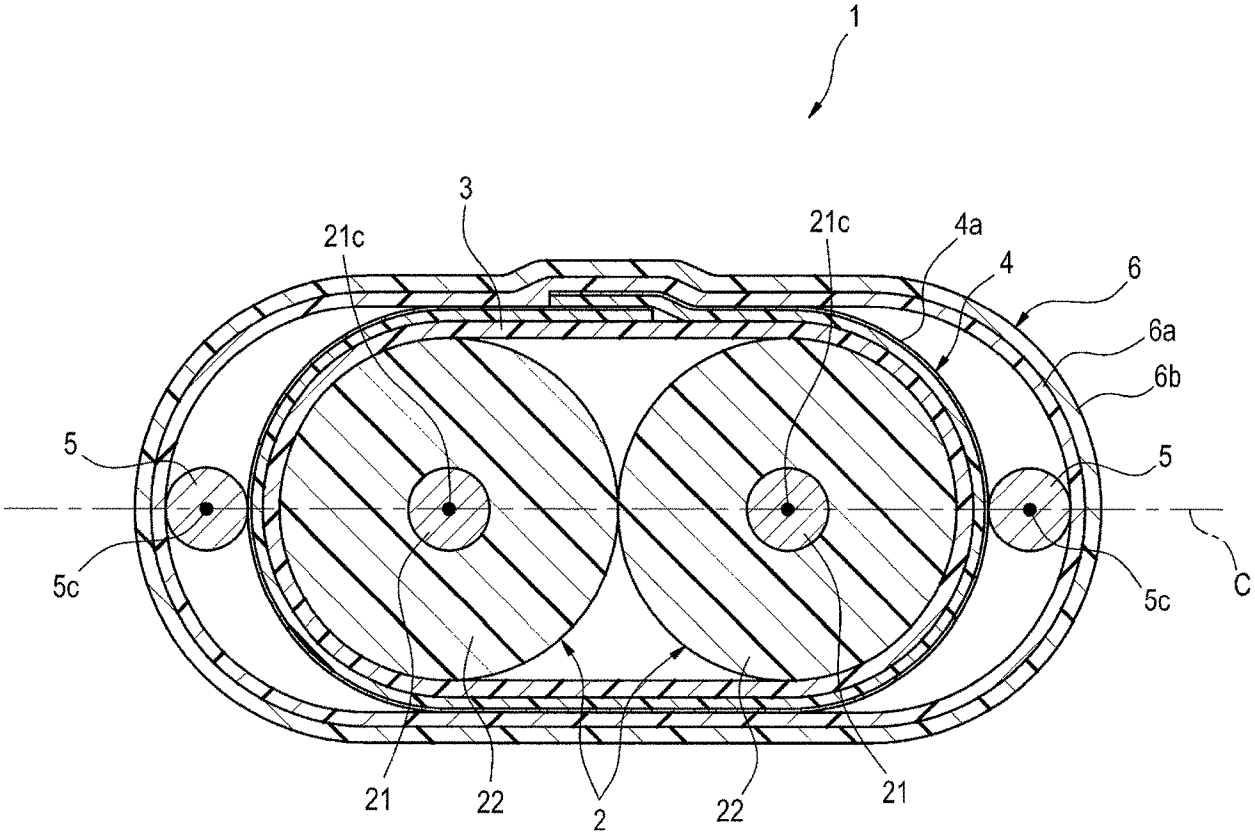
FIG. 2 is a sectional view taken perpendicular to a longitudinal direction of the parallel pair cable in FIG. 1.

As shown in FIGS. 1 and 2, the parallel pair cable 1 according to the first embodiment includes a pair of insulated wires 2 arranged to be in contact with and parallel to each other. The two insulated wires are not twisted. A first resin tape 3 wrapped around the pair of insulated wires 2. The parallel pair cable 1 includes a shield tape 4 wrapped (longitudinally folded) on the outside of the first resin tape 3, drain wires 5 arranged outside the shield tape 4, and a jacket layer 6 provided around the shield tape 4 and the drain wires 5.

Each of the insulated wires 2 is constituted of a signal conductor 21 provided at the center thereof and an insulator 22 covered around the signal conductor 21. The signal conductor 21 is, for example, a single wire or stranded wire formed of a conductor, such as copper or aluminum, or a conductor plated with tin, silver or the like. A size of the conductor used for the signal conductor 21 is, for example, AWG38 to AWG22, when indicated in accordance with AWG (American Wire Gauge) standard. The insulator 22 is formed of, for example, polyethylene (PE), ethylene-vinyl acetate copolymer (EVA), fluoride resin or the like. An outer diameter of the insulated wire 2 is, for example, about 0.3 mm to 3.0 mm, and for example in a case where the signal conductor 21 of AWG30 is employed, is about 0.9 mm.

The first resin tape 3 is formed of a resin tape, such as polyethylene terephthalate (PET) or polyvinyl chloride (PVC). An adhesive is preferably applied to one surface of the first resin tape 3. The surface, on which the adhesive is to be applied, may be an inner surface to come in contact with the pair of insulated wires 2 or an outer surface not to come in contact therewith. The wrapped first resin tape keeps wrapped shape because overlapping portions thereof are fixed to each other with the adhesive. The first resin tape 3 is preferably helically wrapped (spirally wrapped) around the pair of insulated wires 2. The helically wrapped first resin tape 3 is wrapped so that portions of the wrapped tape overlap each other. A thickness of the first resin tape 3 is, for example, about 4 μm to 50 μm.

The resin tape 3 is spirally wrapped, and therefore the center lines of the two signal conductors are arranged almost a parallel on a plane. When the two insulated wires are disposed merely in parallel and in contact with each other, each insulated wire meanders and the center line of each wire does not become ideally straight and it waves on a hypothetical plane. When the resin tape is wrapped on the insulated wires, the insulated wires are kept in almost straight and the center line of the wires meander lesser. And thereby, the characteristic impedance of the cable scarcely fluctuates along the longitudinal direction. In other words, the transmission characteristic of the cable is improved.

The shield tape 4 is formed of, for example, a metal layered resin tape, in which a metal layer 4*a*, such as copper or aluminum, is adhered or deposited on a resin tape, such as PET. A thickness of the shield tape 4 is, for example, about 10 μm to 50 μm, and a thickness of the metal layer 4*a* is, for example, about 0.1 μm to 20 μm. Alternatively, as the shield tape 4, for example, a metal foil, or a metal layered resin tape, in which metal tapes are bonded on both surfaces of a resin tape, may be employed. The shield tape 4 is longitudinally folded on the outside of the first resin tape 3. The longitudinally folded shield tape 4 is preferably configured so that an adhesive is applied to portions thereof to overlap each other. The overlapping portions are fixed to each other with the adhesive, and thus the wrapped shape is kept. Also, the shield tape 4 may be wrapped so that the metal layer 4*a* is arranged on the outside.

A drain wire may be arranged along the insulated wires 2. For example, the two drain wires 5 are arranged to bilaterall-symmetrical with respect to insulated wires 2 as shown in FIG. 2. The drain wires 5 are arranged on the line which intersects the two center lines of the conductors and they are arranged between the shield tape 4 and a second resin tape 6*a*. In the example of FIG. 2, a center point 5*c* of each drain wire 5 and a center point 21*c* of each of signal conductors 21 may be preferably arranged to be placed on a straight line (straight line C). Alternatively, only one drain wire 5 may be employed. The drain wires 5 are provided to be in electrical contact with the metal layer 4*a* arranged on the outside of the shield tape 4. An outer diameter of the drain wires 5 is, for example, about 0.08 mm to 0.8 mm.

Figure 3:
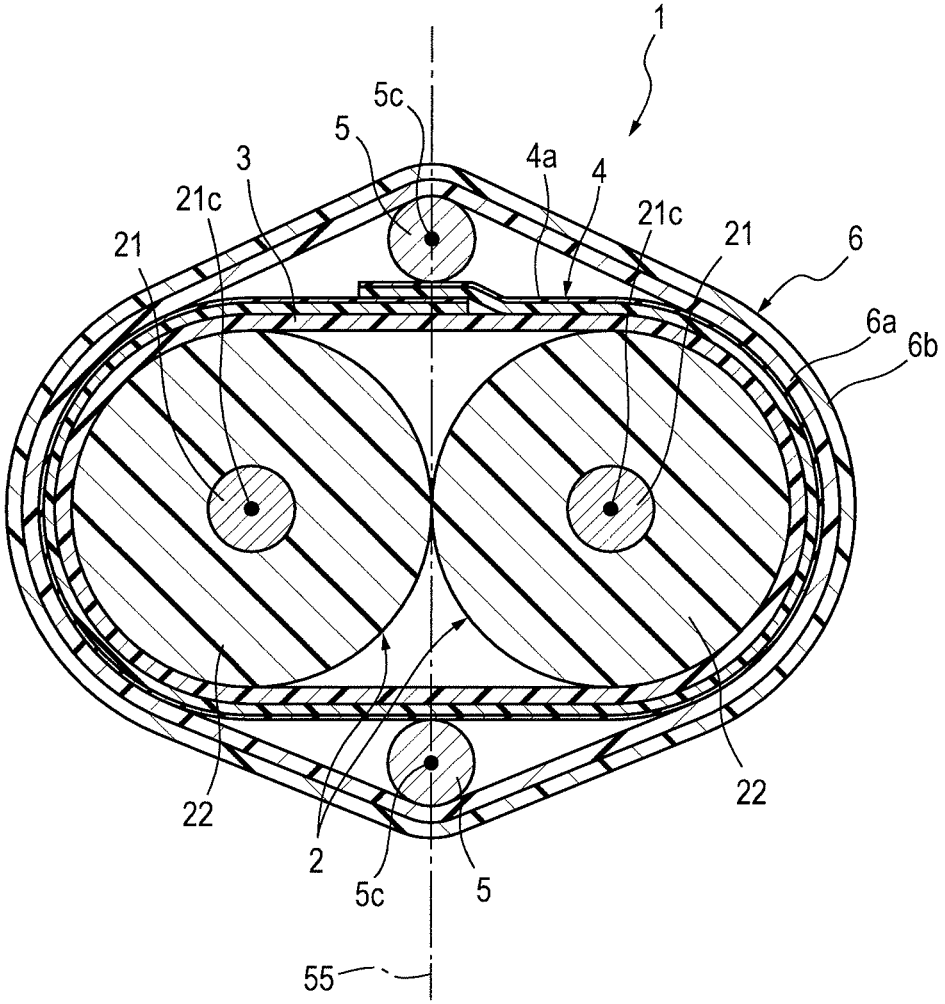
FIG. 3 is a sectional view taken perpendicular to a longitudinal direction of another parallel pair cable.

The drain wires may be arranged vertically and sandwich a contact portion 25 where the two insulated wires 2 are in contact with each other as shown in FIG. 3. In FIG. 3, the second resin tape 6 is helically wrapped (spirally wrapped) around the shield tape 4 and the drain wires 5. A line 55 intersecting the center points 5*c* of the two drain wires 5 passes through the contact portion 25 of the two insulated wires 2. The metal layer 4*a* of the shield tape 4 and each drain wire 5 are arranged so that they are in contact with each other. In the case that the metal layer 4*a* is arranged on the outside of the shield tape 4 as shown in FIG. 3, the drain wires 5 are arranged between the shield tape 4 and the second resin tape 6. In the case that the metal layer 4*a* is arranged on the inside of the shield tape 4, the drain lines 5 are arranged between the first resin tape 3 and the shield tape 4.

The jacket layer 6 is an insulating layer formed by wrapping a resin tape, such as PET or PVC. The jacket layer 6 is formed to have a plurality of layers, and in this example, to have two layers including second resin tapes 6*a* and 6*b*. A thickness of the second resin tapes 6*a*, 6*b* is, for example, about 4 μm to 50 μm. Alternatively, the jacket layer 6 may have only one layer. The second resin tapes 6*a*, 6*b* are preferably helically wrapped (spirally wrapped) around the shield tape 4 and the drain wires 5. In this example, a wrapping direction, in which the second resin tape 6*a* or 6*b* is wrapped, is opposite to a wrapping direction of the first resin tape 3. A wrapping direction of each of the second resin tapes 6*a*, 6*b* may be opposite to each other and thus one of the second resin tapes may be wrapped in the same direction as that of the first resin tape. For example, when the jacket layer 6 is formed to have two layers, an adhesive may be applied on one surface of one 6*a* (or 6*b*) of the second resin tapes, thereby enhancing adhesion strength between layers. In order to make a mark on the parallel pair cable 1, a colored tape may be placed between layers. Alternatively, the jacket layer 6 may be formed by extrusion-molding a thermoplastic resin, such as polyethylene, polyvinyl chloride or fluoropolymer.

According to the parallel pair cable 1 configured as described above, the pair of insulated wires 2 arranged to be in contact with and parallel to each other without twisting are wrapped with the first resin tape 3, thereby reliably fixing positions of two insulated wires 2 relative to each other. When the first resin tape 3 is helically wrapped around the insulated wires 2, a gap is less created between the tape and the wires even when the cable is bent, as compared with a case of longitudinal folded.

Also, since the adhesive is applied on either surface of the first resin tape 3, the helically wrapped first resin tape 3 is adhered to itself in the overlapping portions of the first resin tape 3, thereby ensuring that the first resin tape 3 is fixedly wrapped without being loosened. Also, when the adhesive is applied to the inner surface of the first resin tape 3, the adhesive is in direct contact with the two insulated wires 2 when the first resin tape 3 is wrapped thereon, thereby ensuring that the first resin tape 3 is further firmly fixed. In addition, when the adhesive is applied to the outer surface of the first resin tape 3, the shield tape 4 wrapped on the outside of the first resin tape 3 is adhered to the first resin tape 3 with the adhesive and thus the shield tape 4 is indirectly adhered to the insulted wires 2, so that the insulated wires 2 are fixed by the shield tape 4. The relative position of the insulated wires 2 and the shield tape 4 is fixed in the longitudinal direction.

Further, since the shield tape 4 is longitudinally folded on the outside of the first resin tape 3, an enhanced electrical property can be obtained as compared with a case that the shield tape is spirally wrapped (i.e., when a high frequency signal is transmitted therethrough, there is no case where attenuation of a signal at a specific high frequency is suddenly increased). Also, since the shield tape 4 is wrapped so that the metal layer 4*a* is arranged on the outside and also the drain wires 5 are provided outside the shield tape 4, there is no drain wire 5 inside the shield tape 4 and thus the inner surface of the shield tape 4 can be brought into close contact with the first resin tape 3 inside thereof without a gap therebetween.

Assuming that the drain wires 5 are arranged inside the shield tape 4, the inside of the shield tape 4 has a convex shape at sites, in which the drain wires 5 are positioned, and the sites are not in close contact with the insulated wires 2 (via the first resin tape 3). Contrarily, according to the present embodiment, since the drain wires 5 are arranged outside the shield tape 4, there is no convex-shaped site and thus a degree of close contact thereof with the insulated wires 2 (via the first resin tape 3) is better. Therefore, a dielectric constant inside the shield tape 4 can be stabilized, thereby reducing insertion loss of the parallel pair cable 1. Also, when two drain wires 5 are bilateral-symmetrically arranged as shown in FIG. 2, each of the insulated wires 2 is symmetrically crushed due to pressing from the respective drain wires 5. Accordingly, the parallel pair cable 1 does not become asymmetric. Therefore, stability of the dielectric constant inside the shield tape 4 is further increased. As a result, a shielding effect of the shield tape 4 on the insulated wires (signal lines) 2 can be stabilized and also an amount of output of common mode (Scd21) with respect to input signal of differential mode can be reduced.

Further, by provided the jacket layer 6 (second resin tapes 6*a*, 6*b*) around the shield tape 4 and the drain wires 5, the shield tape 4 can be electrically insulated and also the cable can be configured to be protected and to have water resistance. In addition, since the second resin tapes 6*a*, 6*b* are wrapped, the metal layer 4*a* of the shield tape 4 and the drain wires 5 arranged outside the shield tape 4 are reliably brought into electrical contact with each other over the entire length of the parallel pair cable 1. Two drain wires 5 can be at symmetric positions with respect to the insulated wires 2. Therefore, the insulators 22 of the insulated wires 2 are equally crushed and thus are prevented from becoming asymmetric, thereby stabilizing the dielectric constant inside the shield. The second resin tapes are preferably helically wrapped (spirally wrapped). When at least one of the second resin tapes 6*a*, 6*b* is wrapped in a direction opposite to that of the first resin tape 3, it can relieve the twist applied to the parallel pair cable.

Second Embodiment

Figure 4:
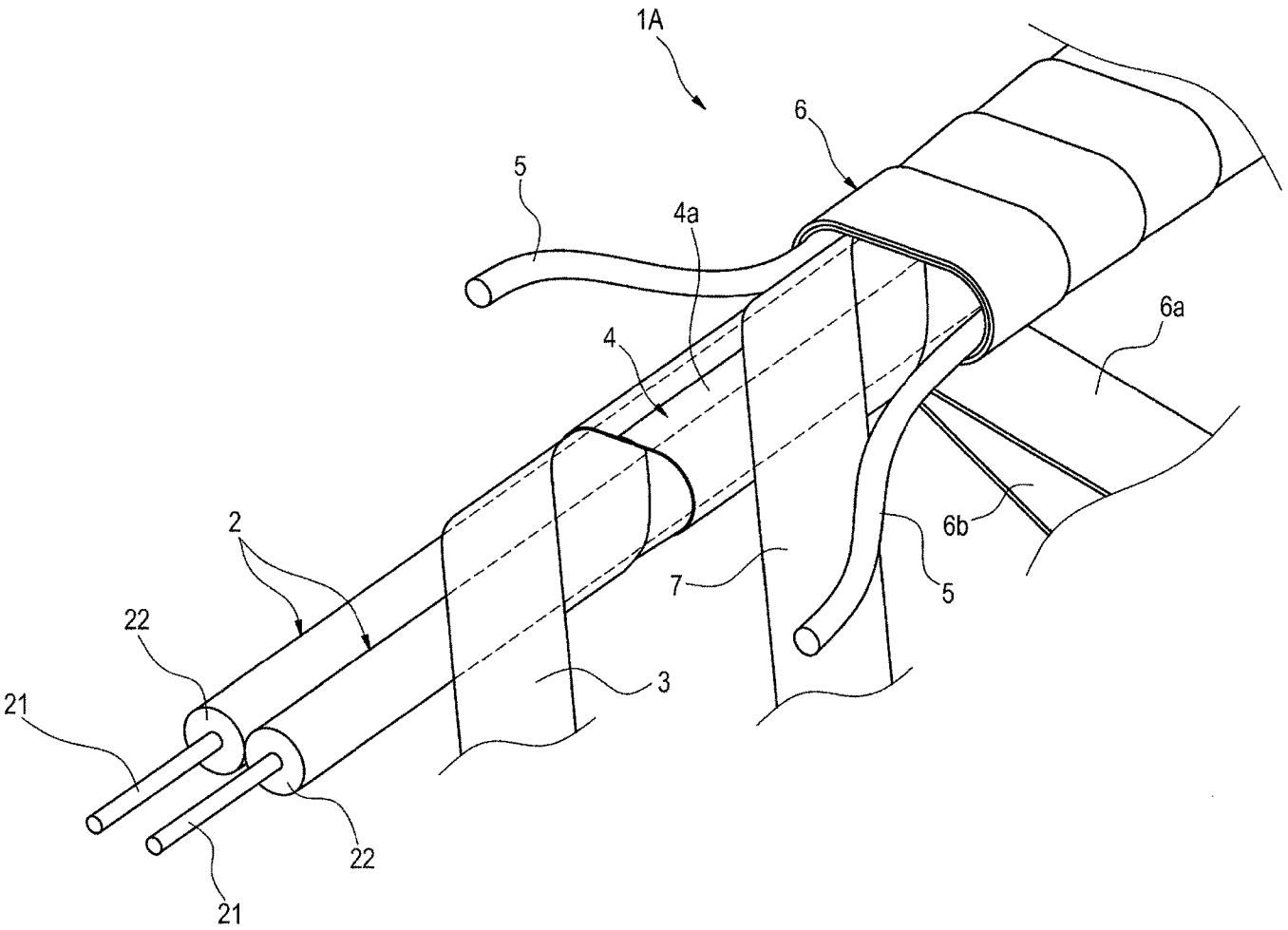
FIG. 4 is a perspective view showing another configuration of a parallel pair cable according to a second embodiment.
Figure 5:
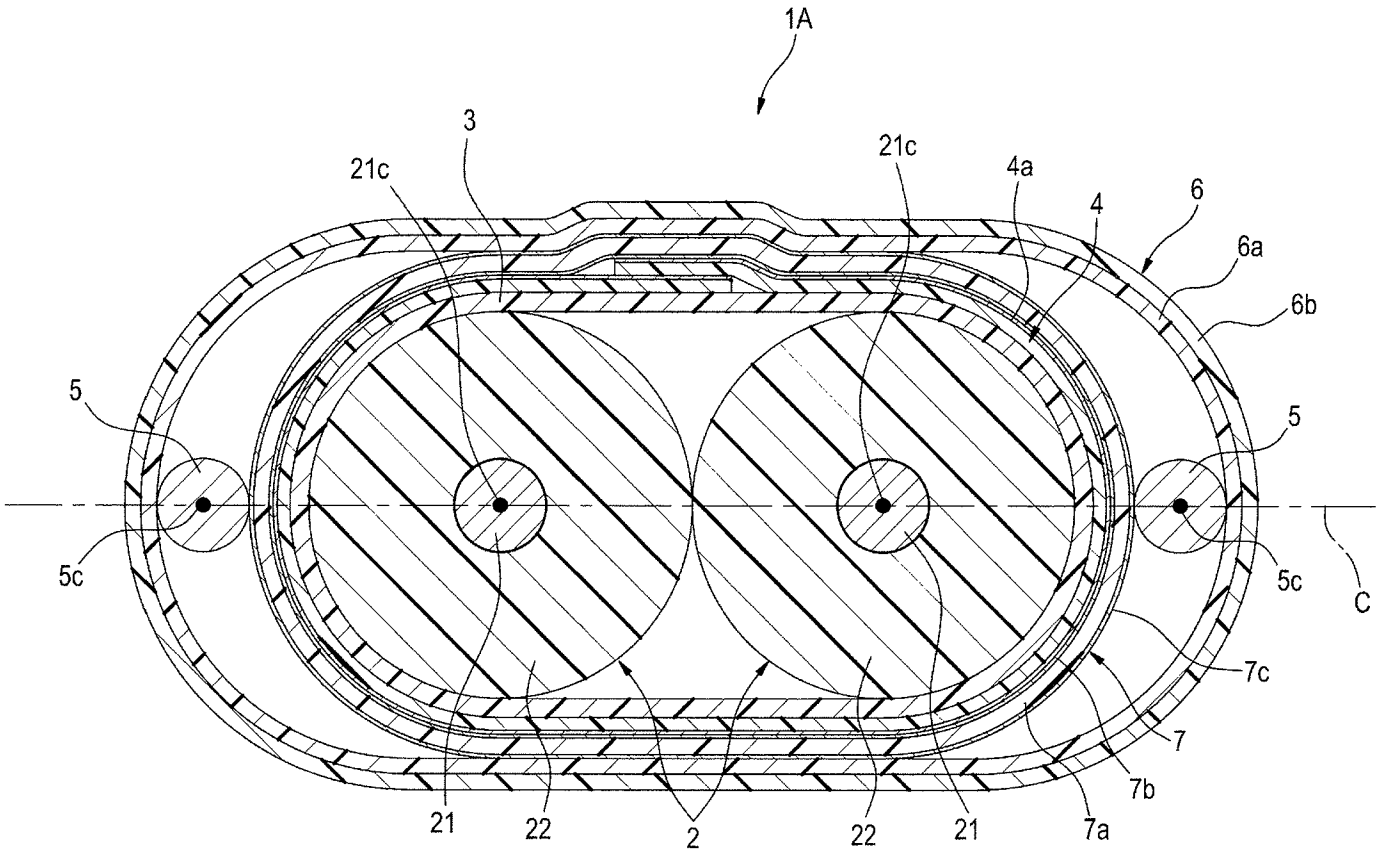
FIG. 5 is a sectional view taken along to a longitudinal direction of the parallel pair cable in FIG. 4.

As shown in FIGS. 4 and 5, a parallel pair cable 1A of the second embodiment includes a conductive tape 7 between a shield tape 4 and drain wires 5. Components of the parallel pair cable 1A other than the conductive tape 7 are the same as those of the parallel pair cable 1 according to the first embodiment as described above. Accordingly, the same components will be designated by the same reference numerals and the description thereof will be omitted.

The conductive tape 7 is helically wrapped (spirally wrapped) on an outer circumference of the shield tape 4. The conductive tape 7 is constituted of tape-shaped metals (e.g., copper or aluminum) 7*b*, 7*c* bonded on both surface of tape-shaped resin (e.g., PET) 7*a*. Alternatively, on either surface of the tape-shaped resin 7*a*, such a metal may be deposited, instead of using the tape-shaped metal 7*b* or 7*c*.

The conductive tape 7 is wrapped in such a manner that the conductive tape 7 partially overlaps itself. Accordingly, in portions of the conductive tape 7 overlapping each other, the tape-shaped metal 7*b* on an inner surface of the conductive tape 7 is in contact with the tape-shaped metal 7*c* on the outer surface thereof. The metal 7*b* has a thickness of 0.01 μm to 50 μm and may be provided by depositing a metal on the tape-shaped resin 7*a* or bonding a metal foil on the tape-shaped resin 7*a*. The conductive tape 7 has a width of 2 mm to 10 mm and a thickness of 12 μm to 70 μm. Also, the conductive tape 7 has a wrapping pitch of 1 mm to 10 mm and thus is wrapped with a pitch smaller than the width of the conductive tape 7 in such a manner that the conductive tape 7 partially overlaps itself as described above. Therefore, the tape-shaped metals 7*b* and 7*c* are electrically connected with each other. Also, in the example of FIG. 4, a wrapping direction of the conductive tape 7 is the same as the wrapping direction of the first resin tape 3, but alternatively may be opposite thereto.

Further, the conductive tape 7 has an adhesive applied on a surface of the tape-shaped metal 7*b* on the inner surface thereof, for example in a zebra shape or polka dot shape, and thus portions thereof, on which the adhesive is not applied, are in contact with the shield tape 4. Therefore, the metal layer 4*a* of the shield tape 4 and the tape-shaped metal 7*b* are electrically connected with each other.

Further, in the parallel pair cable 1A according to the second embodiment, drain wires 5 are longitudinally arranged between the conductive tape 7 and the second resin tapes 6*a* and are in electrical contact with the tape-shaped metal 7*c* on the outer surface of the conductive tape 7. Meanwhile, the number of the second resin tapes may be one, but not two. As described above, since the tape-shaped metals 7*b* and 7*c* are electrically connected with each other, the metal layer 4*a* of the shield tape 4 and the tape-shaped metal 7*c* on the outer surface of the conductive tape 7 are also electrically connected with each other. As a result, the shield tape 4 and the drain wires 5 in the parallel pair cable 1A are electrically connected with each other. Positions of the drain wires are not limited to locations shown in FIG. 5. For example, the drain wires may be positioned at locations rotated from the locations in FIG. 5 by 90° about a contact portion where two insulated wires are in contact with each other, so that one drain wire is arranged on each of upper and lower side of the shield tape 4 while being in contact with the shield tape 4.

According to the parallel pair cable 1A of the second embodiment, the conductive tape 7 is helically wrapped (spirally wrapped) on the outer circumference of the shield tape 4. Therefore, a crease is less created on the shield tape 4 and also an un-uniformity in shielding effect of the shield tape 4 on the insulated wires (signal lines) 2 is less occurred. As a result, an amount of output of common mode (Scd21) with respect to input signal of differential mode can be reduced and also an un-uniformity thereof can be reduced.

EXAMPLES

Analysis results of an amount of mode conversion (Scd21) in parallel pair cables according to Examples and Comparative Example will be described Meanwhile, Scd21 means an amount of differential mode to common mode conversion, from a port 1 to a port 2, and is one of mixed-mode S-parameters. In a compliance test of USB cables (e.g., USB 3.0), Scd21 value is set to −20 dB/m or lower.

In the following analysis, when a high frequency signal of 20 Ghz or higher was transmitted through a parallel pair cable having a length of 3 m, the cable was evaluated as good when the maximum of Scd21 value was −20 dB/m or lower, and also was evaluated as excellent when the maximum of Scd21 value was −25 dB/m or lower. In addition, when the maximum of Scd21 value was higher than −20 dB/m, the cable was evaluated as poor.

Example 1

A parallel pair cable of Example 1 had the configuration according to the first embodiment shown in FIG. 2 and was manufactured as follows.

Two insulated wires 2, which each had a signal conductor 21 of AWG30 and a diameter of 0.96 mm and were arranged parallel to each other, were employed. A first resin tape 3, which had a thickness of 12 μm (an adhesive was applied to an inner surface thereof), was helically wrapped in a counterclockwise direction around the insulated wires 2, as in FIG. 1, and then, a shield tape 4, which was a metal resin tape (a thickness of 21 μm) having a metal layer 4*a* (a thickness of 8 μm) made of copper, was longitudinally folded on the outside of the first resin tape 3, as in FIG. 1, in such a manner that the metal layer 4*a* was arranged on the outside. Two drain wires 5 were respectively arranged straightly along the longitudinal direction outside the shield tape 4 on both lateral sides of the insulated wires 2 (as shown in FIG. 2). Then, two layers of second resin tapes 6*a* (a thickness of 12 μm) and 6*b* (a thickness of 12 μm) were helically wrapped around the shield tape 4 and the drain wires 5, as in FIG. 1, in such a manner that both layers were wrapped in a clockwise direction, thereby forming a jacket layer 6.

The parallel pair cable of Example 1 having the above configuration was prepared to have a length of 3 m, and a high frequency signal of 20 GHz or higher was transmitted therethrough. Then, Scd21 was measured.

As a result, the maximum of the Scd21 value was −25 dB/3 m or lower (value with respect to the measured length), and thus a quality of the parallel pair cable of Example 1 was evaluated as excellent.

Example 2

A parallel pair cable of Example 2 had the configuration according to the first embodiment shown in FIG. 2 and was manufactured as follows.

Insulated wires 2 had the same configuration as that of Example 1. A first resin tape 3 (the same as that of Example 1) was helically wrapped around the insulated wires 2, but in such a manner that the first resin tape 3 was wrapped in a clockwise direction, which was opposite to that of FIG. 1, and an adhesive was arranged on the outside. A shield tape 4 and drain wires 5 were the same configurations as those of Example 1. Then, two layers of second resin tapes 6*a*, 6*b* (jacket layer 6) were helically wrapped around the shield tape 4 and the drain wires 5, but in such a manner that both layers were wrapped in a counterclockwise direction, which was opposite to that of FIG. 1. Meanwhile, a diameter and a thickness of each component were the same as those of Example 1.

The parallel pair cable of Example 2 having the above configuration was prepared to have a length of 3 m, and then a high frequency signal of 20 GHz or higher was transmitted therethrough. Then, Scd21 was measured.

As a result of analysis, the maximum of the Scd21 value was −25 dB/3 m or lower, and thus a quality of the parallel pair cable of Example 2 was evaluated as excellent.

Example 3

A parallel pair cable of Example 3 had the configuration according to the first embodiment shown in FIG. 2, except a jacket layer 6, and was manufactured as follows.

The jacket layer 6 was formed by extrusion-molding a thermoplastic polyvinyl chloride (a thickness of the jacket layer 6 was 24 μm). The other components were manufactured in the same manner as those of Example 1. Meanwhile, a diameter and a thickness of each component were the same as those of Example 1, except the thickness of the jacket layer 6.

The parallel pair cable of Example 3 having the above configuration was prepared to have a length of 3 m, and a high frequency signal of 20 GHz or higher was transmitted therethrough. Then, an analysis on Scd21 was performed.

As a result of analysis, the maximum of the Scd21 value was −20 dB/3 m or lower, and thus a quality of the parallel pair cable of Example 3 was evaluated as good.

Example 4

A parallel pair cable of Example 4 had the configuration according to the second embodiment shown in FIG. 5 and was manufactured as follows.

The parallel pair cable of Example 4 had the same configuration as those of Example 1, except a conductive tape 7. As the conductive tape 7, a tape in which tape-shaped metals (copper) 7*b*, 7*c* having a thickness of 10 μm were bonded on both surfaces of a tape-shaped resin (PET) 7*a* having a width of 10 mm and a thickness of 12 μm, was employed. The conductive wire 7 was helically wrapped around an outer circumference of a shield tape 4 with a wrapping pitch of 5 mm in a counterclockwise direction (the same direction as a wrapping direction of a first resin tape 3).

Ten parallel pair cables of Example 4 having the above configuration were prepared to have a length of 3 m and then a high frequency signal of 1 to 20 GHz was transmitted therethrough. Then, Scd21 was measured.

Subsequently, an acceptance judgment, in which a case where the maximum value of Scd21 was −30 dB/3 m or less was judged as acceptable, was performed. As a result, all of ten parallel pair cables of Example 4 were acceptable. In addition, for comparison, the acceptance judgment was also performed on Example 1, and as a result, seven of ten parallel pair cables ware acceptable.

Comparative Example 1

A parallel pair cable of Comparative Example 1 had a configuration in which a first resin tape 3 was not provided (not wrapped) around insulated wires 2. The other components were manufactured in the same manner as those of Example 1.

The parallel pair cable of Comparative Example 1 having the above configuration was prepared to have a length of 3 m, and a high frequency signal of 20 GHz or higher was transmitted therethrough. Then, an analysis on Scd21 was performed as described above.

As a result of analysis, the maximum of the Scd21 value was higher than −20 dB/3 m, and thus a quality of the parallel pair cable of Comparative Example 1 was evaluated as poor.

In the foregoing, the present invention has been described in detail with reference to specific embodiments. However, those skilled in the art will appreciate that various changes and modifications may be made without departing from the spirit and scope of the invention. In addition, numbers, positions, shapes and the like of components as described above are not limited to those of the foregoing embodiments, but may be changed to any numbers, positions, shapes and the like suitable to practice the invention.

What is claimed is:

1. A parallel pair cable, comprising:

a pair of insulated wires arranged to be in contact with each other, parallel to each other, and not twisted;

a first resin tape wrapped around the pair of insulated wires;

a shield tape comprising a metal layer longitudinally folded on the outside of the first resin tape;

a drain wire outside the shield tape, wherein the drain wire is arranged to be in electrical contact with the metal layer of the shield tape;

a jacket layer provided around the shield tape and the drain wire; and a conductive tape helically wrapped on the outside of the shield tape, wherein the drain wire is arranged on the outside of the conductive tape so that the drain wire is electrically connected to the conductive tape and the shield tape; and wherein the jacket layer is provided around the conductive tape and the drain wire.

2. The parallel pair cable according to claim 1, wherein the jacket layer is a layer formed by wrapping a second resin tape around the shield tape and the drain wire.

3. The parallel pair cable according to claim 2, wherein a wrapping direction of the second resin tape is opposite to a wrapping direction of the first resin tape.

* * * * *